US006616132B1

(12) United States Patent
Ellison

(10) Patent No.: US 6,616,132 B1
(45) Date of Patent: Sep. 9, 2003

(54) PLANKING TOOL

(76) Inventor: Melvin Ray Ellison, Rte. 1, Box 15C, Brevard, NC (US) 28712

( * ) Notice: Subject to any disclaimer, the term of this patent is extended or adjusted under 35 U.S.C. 154(b) by 0 days.

(21) Appl. No.: 10/328,908

(22) Filed: Dec. 24, 2002

(51) Int. Cl.[7] ..... B66F 3/00
(52) U.S. Cl. ..... 269/15; 269/17
(58) Field of Search ..... 269/15, 17, 11, 269/271, 25, 120, 16, 104, 236

(56) References Cited

U.S. PATENT DOCUMENTS

| | | | | | |
|---|---|---|---|---|---|
| 32,120 | A | | 4/1861 | Clough | |
| 396,104 | A | | 1/1889 | Morrill | |
| 721,681 | A | | 3/1903 | Early | |
| 1,512,356 | A | * | 10/1924 | Miller | 254/15 |
| 1,911,705 | A | | 5/1933 | McMullen | |
| 2,351,691 | A | | 6/1944 | Mansir | 254/15 |
| 2,427,268 | A | | 9/1947 | Fleming et al. | 254/16 |
| 2,823,011 | A | | 2/1958 | Jones | 254/15 |
| 3,331,584 | A | | 7/1967 | Schwartz | 254/15 |
| 3,523,623 | A | | 8/1970 | Campbell | 254/15 |
| 4,621,791 | A | | 11/1986 | Staskiewicz et al. | 254/17 |
| 5,139,231 | A | | 8/1992 | Temple | 254/15 |
| 5,190,266 | A | * | 3/1993 | Barrera | 254/17 |
| 5,248,127 | A | | 9/1993 | Young | 254/15 |
| 5,456,053 | A | | 10/1995 | Fischer | 52/749.1 |
| 5,527,014 | A | * | 6/1996 | Bracewell | 254/15 |
| 5,826,858 | A | | 10/1998 | Gordon | 254/17 |
| 5,964,450 | A | | 10/1999 | Pasto | 254/11 |
| 5,971,361 | A | | 10/1999 | Heimbach | 254/16 |
| 6,324,803 | B1 | | 12/2001 | Pervan | 52/403.1 |
| 6,370,836 | B1 | | 4/2002 | Gunn | 52/749.1 |

* cited by examiner

*Primary Examiner*—Lee D. Wilson
(74) *Attorney, Agent, or Firm*—Joseph T. Guy; Nexsen Pruet Jacobs & Pollard, LLC

(57) ABSTRACT

A planking tool comprising a base, a handle mechanism rotatably attached to the base and a pair of teeth slidably attached to the base wherein the teeth are movable between an engaging position and a disengaging position. A first connecting mechanism attaches the handle mechanism to the pair of teeth. A push plate slidably attached to the base is slidable between an extended position and a withdrawn position. A second connecting mechanism attaches the handle mechanism to the push plate. When the handle is rotated relative to the base the pair of teeth move from the disengaging position to the engaging position while the push plate remains in the withdrawn position. As the handle continues to rotate relative to the base the pair of teeth remain in the engaging position and the push plate moves from the withdrawn position to the extended position.

19 Claims, 3 Drawing Sheets

PLANKING TOOL

TECHNICAL FIELD

The present invention is directed to a tool specifically designed to improve the efficiency of installing planks in a parallel fashion on a surface, such as a floor, wall or ceiling. More specifically, the present invention is directed to an improved tool and method for installing planks on joist wherein the planks must be pushed into alignment prior to being secured to the joist.

BACKGROUND

The installation of planks, particularly tongue and groove planks, to form floors walls and ceilings is a standard practice in the construction industry. Typically a first plank is placed in the appropriate position and secured to the underlying joist by a securing device such as nails, screws, adhesive and the like. Each subsequent plank is then persuaded into a parallel arrangement with the previous plank and secured in position. With tongue and groove planking each subsequent plank has a tongue on one edge and a groove on the opposite edge. The tongue of one plank engages the groove of the adjacent plank thereby forming an interlinked element.

It is well known that planks are not consistent, particularly with regard to their linearity, and with regards to the dimensions of the tongue and groove. It is therefore necessary to forcibly persuade each plank into the proper position prior to securing the plank to the underlying joist. This is both time consuming and critical to the formation of an aesthetically pleasing surface. Many methods of forcing a plank into engagement with the previously secured plank are reported.

Methods that draw planks together, such as exemplified in U.S. Pat. No. 6,370,836, require both long edges of a series of planks to be accessible. This is not practical in most installations. Furthermore, the width within which this device may be used is limited. If a large area is being done, for example, the device becomes cumbersome to operate.

It is most desirable for the planking tool to engage with the underlying joist. U.S. Pat. No. 4,621,791 describes such a device yet this device is deficient in that the force is placed on a visible corner of the plank. It is common for the force required to distort a plank into linearity to be more than sufficient to cause an indentation in the surface of the plank. This is even more observable when the force is applied to a corner of the plank. This is aesthetically undesirable. It is most desirable to place force on an area of the plank with minimal visibility and that the force be applied in a large area to minimize damage.

Methods are described wherein underlying mechanical locking devices are employed. Such system is exemplified in U.S. Pat. No. 6,324,803. This system is expensive due to the additional hardware and the additional, time consuming, process of securing a mechanical device to the joist prior to placing the plank in the proper location.

There are a myriad of devices involving opposing binding relationships between a joist and the plank. In each case, the force applied on the plank binds the harness on the joist thereby allowing the plank to be forced into proper positioning. Examples of such devices are provided in U.S. Pat. Nos. 5,826,858; 5,248,127; 3,331,584; 2,823,011; 1,911,705 and 32,120. In these devices the motion of the grasping mechanism is directly correlated with the pushing mechanism. This is undesirable. The force applied to the plank and the security of the harness on the joist are correlated thereby creating a constant possibility of slipping that creates a hazard to the user.

Similar devices rely on protrusions that engage with the joist as exemplified in U.S. Pat. Nos. 3,524,623, 2,427,268 and 2,351,691. These devices are detrimental to the surface of the joist. In severe cases the surface of the joist can be damaged to a degree such the surface is uneven and an overlying plank may be unlevel or gaps between the joist and the plank may be created. Gaps may lead to squeaks when the planks are applied as a floor. These devices are certainly not acceptable in cases where exposed joist construction is desired.

The above-cited deficiencies have been partially met by devices that have one mechanism for securing the device to the joist and a separate mechanism for pushing the plank. U.S. Pat. No. 5,456,053, for example, comprises a handle, which, in one configuration, tightens the gripping mechanism against the joist and in a second configuration pushes the plank. This is time consuming. Similar devices are described in U.S. Pat. Nos. 5,139,231; 721,681 and 396,104.

Regardless of the many varied attempts to form a suitable device for forcing planks into alignment the art still lacks a device which securely grasp the joist, without requiring multiple actions, and which can supply sufficient force without damaging either the joist or the plank. Such an improved device is provided by the present invention.

SUMMARY

It is an object of the present invention to provide a planking tool, which assist an installer in the proper alignment of planks.

It is another object of the present invention to provide a planking tool which is easy to use and which does not require multiple operations.

It is yet another object of the present invention to provide a planking tool which can provide a sufficient amount of force without damage to either the underlying joist or the plank.

A particular feature of the present invention is the ability to operate the device with one hand while using the other hand to operate a mechanical hammer or the like.

Another particular feature of the present invention is the ability to sequentially grasp the joist followed by the application of force to the plank. Continued action then increases the force applied to the joist while also increasing the force applied to the plank.

These and other objects, as will be realized from the disclosure herein, are provided in a planking tool. The planking tool comprises a base, a handle mechanism rotatably attached to the base and a pair of teeth slidably attached to the base wherein the teeth are movable between an engaging position and a disengaging position. A first connecting mechanism attaches the handle mechanism to the pair of teeth. A push plate slidably attached to the base is slidable between an extended position and a withdrawn position. A second connecting mechanism attaches the handle mechanism to the push plate. When the handle is rotated relative to the base the pair of teeth move from the disengaging position to the engaging position while the push plate remains in the withdrawn position. As the handle continues to rotate relative to the base the pair of teeth remain in the engaging position and the push plate moves from the withdrawn position to the extended position.

Another embodiment is provided in a method for installing a plank on a joist. The method comprises the steps of:

a) placing said plank on the joist;

b) placing a planking tool on the joist wherein the planking tool comprises a handle, a pair of opposing teeth and an extension mechanism;

c) moving the handle of the planking tool toward the plank wherein the opposing teeth engage the plank;

d) moving the handle of the planking tool further towards the plank wherein the extension mechanism pushes the plank to an engaged relationship with a previously installed second plank; and e) securing said plank to said joist.

Yet another embodiment is provided in a planking tool comprising a base an actuating plate rotatably attached to the base and a pair of opposing teach slidably attached to the base. A connector is attached between the actuating plate and a tooth of the pair of opposing teeth. A push plate is extendable from the base. A connecting rod is slidably connected to the actuating plate and connected to the push plate. When the handle is rotated relative to the base the tooth slides to an engaging relationship while the connecting rod slides relative to the actuating plate and then the connecting rod moves in concert with the actuating plate causing the push plate to extend from the base.

DETAILED DESCRIPTION

Figure 1:
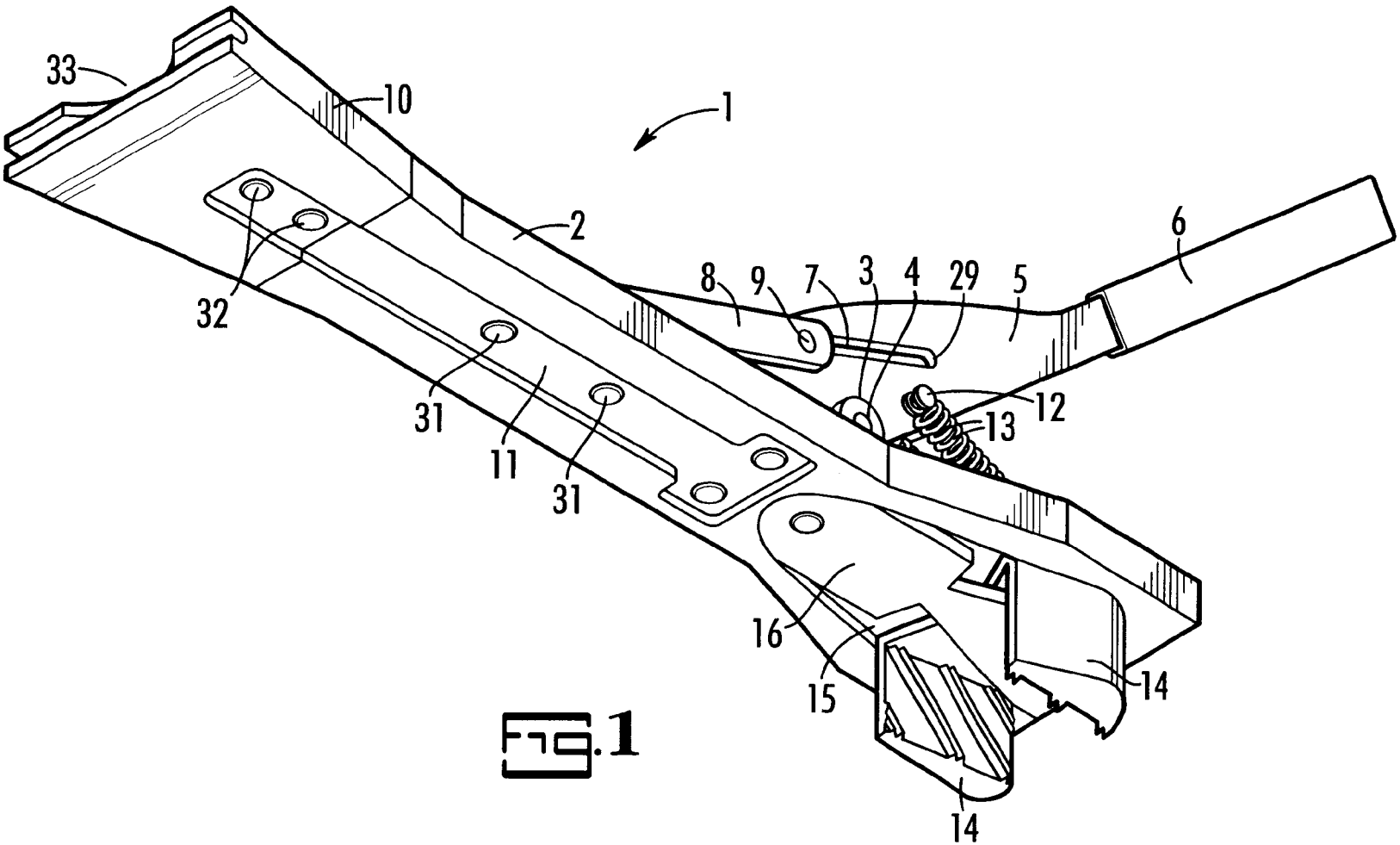
FIG. 1 is a bottom perspective view of the planking tool of the present invention.

The present invention provides a planking tool, which sequentially grasp a joist, and then extends to push a plank into proper proximity. This sequential operation occurs due to a single motion of the handle thereby greatly increasing the efficiency of the planking operation. The planking tool will be described with reference to the accompanying figures, which form a part of the specification. In the drawings similar elements are numbered accordingly.

The planking tool is shown in bottom perspective view in FIG. 1. The planking tool, generally illustrated at 1, comprises a base, 2. Attached to the topside of the base is a handle mechanism pivotally attached to the base. In a particularly preferred embodiment the handle mechanism comprises a handle pivot, 3, and handle axle, 4, upon which an actuating plate, 5, pivots. A handle extension, 6, provides leverage and allows the operator to utilize the planking tool from a kneeling or standing position as desired. The handle extension is either attached to the actuating plate, 5, by a bracket and securing elements or the extending handle and actuating plate are integrally formed as a single piece. The actuating plate, 5, comprises an elongated slot, 7. A connecting bar, 8, is slidably attached to the actuating plate, 5, by a bar axle, 9, which is received within the slot, 7. The connecting bar, 8, is operationally connected to a push plate, 10, preferably by a slide rod, 11. Connectors, 31, are provided for connecting the slide rod, 11, to the connecting bar, 8. A preferred manner in which the slide rod and connecting bar are connected is described further herein. Connectors, 32, connect the slide rod, 11, to the push plate, 10. A pair of springs, 13, are connected to the actuating plate, 5, by any attachment known in the art such as a pin, 12. Each spring is further operationally connected to one of a pair of opposing rear teeth, 14. The teeth are preferably received in a triangulated recess, 15, within the base, 2. The triangulated recess approaches the center of the base moving forward. As the actuating plate is rotated towards the push plate the springs persuade the teeth to be drawn in the direction of the push plate, 10. As the teeth transit towards the push plate the triangulated recess forces the teeth together into increasingly closer proximity. As will be realized the joist will be securely grasped between the teeth, 14. An optional, but preferred spreader, 16, persuades the teeth to separate as they transit rearward thereby releasing the joist as the teeth retreat away from the push plate, 11. The push plate, 10, comprises an optional, but preferred, recess, 33, in the upper face. The recess, 33, allows the operator to insure that the plank is positioned correctly prior to placing pressure on the plank. The helps to avoid damage to the plank that can occur if the plank is not positioned properly.

In another embodiment one tooth is fixed and the second tooth moves as described relative to FIG. 1. Opposed moving teeth are preferred.

As will be apparent from the further description herein, when the actuating plate, 5, is rotated on the handle axle, 4, the springs, 13, persuade the teeth to draw forward. As the teeth draw forward they move together due to the constriction placed on the teeth by the triangulated recess. As the distance between the teeth decreases the joist is engaged there between. The connecting bar slides within the slot, 7, thereby delaying the action of the push plate. In this manner the joist grasping operation commences prior to the extension operation. The connecting bar slides within the slot until the slot expires at the slot rear terminus, 29. Further rotation of the actuation plate, 5, causes the connecting bar, 8, to move in concert with the actuating plate while continuing to increase the pressure exerted on the joist by the teeth due to increasing extension of the spring. The slide rod, 11, slides parallel to the base in concert with the forward movement of the connecting bar, 8. The push plate, 10, extends away from the base in concert with the slide rod. A particular feature of the present invention is the sequential operation wherein the initial motion of the handle causes the grasping operation to commence while the extending operation is relatively dormant. Further motion of the handle continually extends the spring thereby insuring adequate continued force is placed on the teeth to grasp the joist there between while the extending operation commences. The operator simply moves the handle towards the work piece without regard for the multiple staged actions thereby greatly reducing the operators motion while still providing the necessary features.

The operation of the planking tool will be described in more detail with reference to FIGS. 2 and 3.

Figure 2:
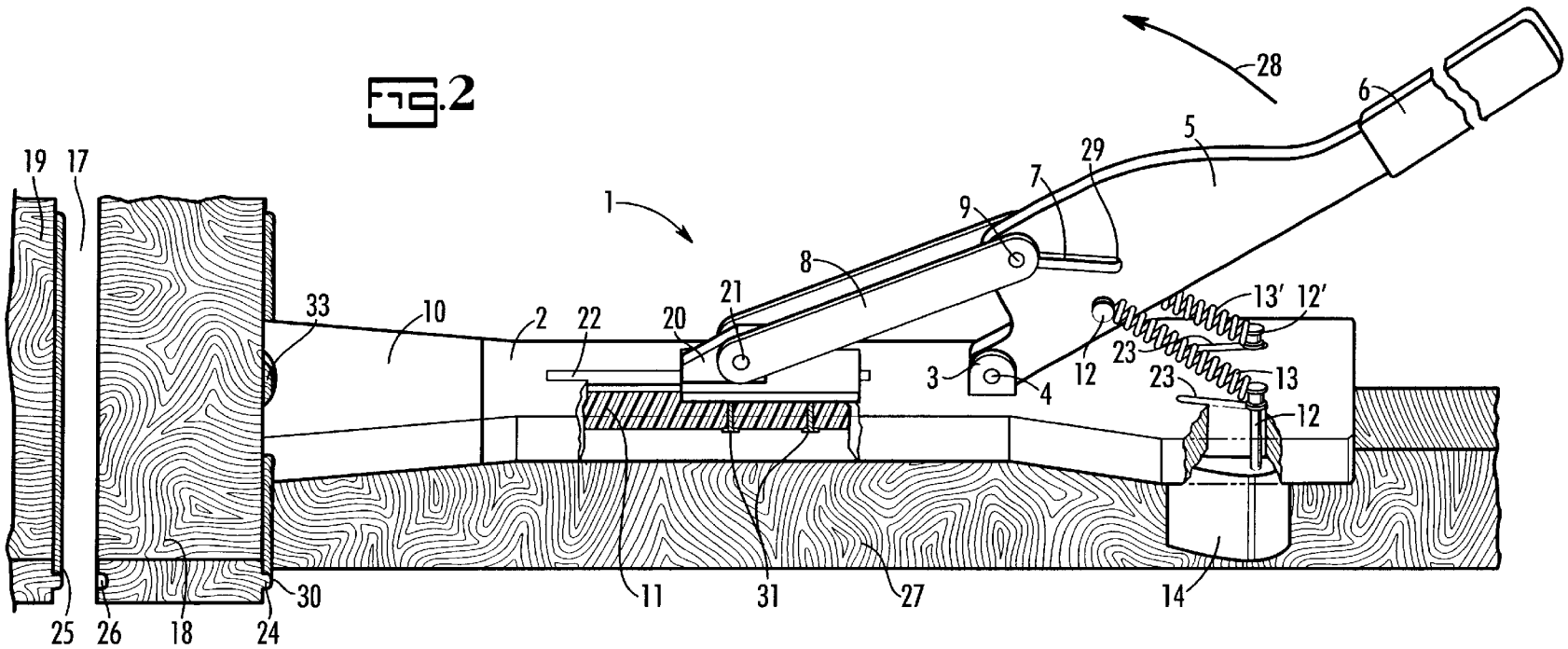
FIG. 2 is a partial cutaway side view of an embodiment of the planking tool as positioned at the initiation of the operation.

FIG. 2 illustrates, in partial cutaway view, the planking tool, 1, in the relaxed position. The base, 2, is placed on the joist, 27. A secured plank, 19, has been previously secured to the joist, 27. A gap, 17, exist between the secured plank, 19, and the installation plank, 18. The gap is typically due to non-linearity of the installation plank and it is the desire of the installer to force the installation plank towards the secured plank thereby eliminating the gap. The gap prohibits the secured plank tongue, 25, from being received by the installation plank groove, 26. In the relaxed configuration, as illustrated in FIG. 2, the actuating plate, 5, is rotated away from the push plate, 10. The push plate, 10, is in a withdrawn position. The springs, 13, are relaxed, or not elongated, and the teeth, 14, are not engaged with the joist. The pins, 12 and 12', are each shown to be slidably received and protruding through a slot, 23. As the handle is pushed forward in the direction of arrow, 28, the actuator plate, 5, rotates and the springs, 13, draw the teeth, 14, forward. The triangular recess (not pictured) causes the teeth to traverse inward towards each other as they travel forward thereby grasping the joist, 27, there between. The bar axle, 9, slides within the slot, 7, until the slot rear terminus, 29, is reached. Any further rotation of the actuating plate, 5, in the direction of arrow, 28, will cause the connecting bar, 8, to move forward in concert with the rotation of the actuating plate, 5. The connecting bar, 8, is pivotally connected to an attachment block, 20, which is further connected to the slide rod, 11, by connectors, 31. The connectors preferably extend through slots, 22. The slide rod is, in turn, connected to the push plate, 10. As the connecting bar is persuaded forward in the direction of arrow, 28, the push plate, 10, persuades the installation plank, 18, towards the secured plank. In a particularly preferred embodiment the push plate, 10, comprises a groove, 30, for receiving the tongue, 24, of the installation plank, 18.

Figure 3:
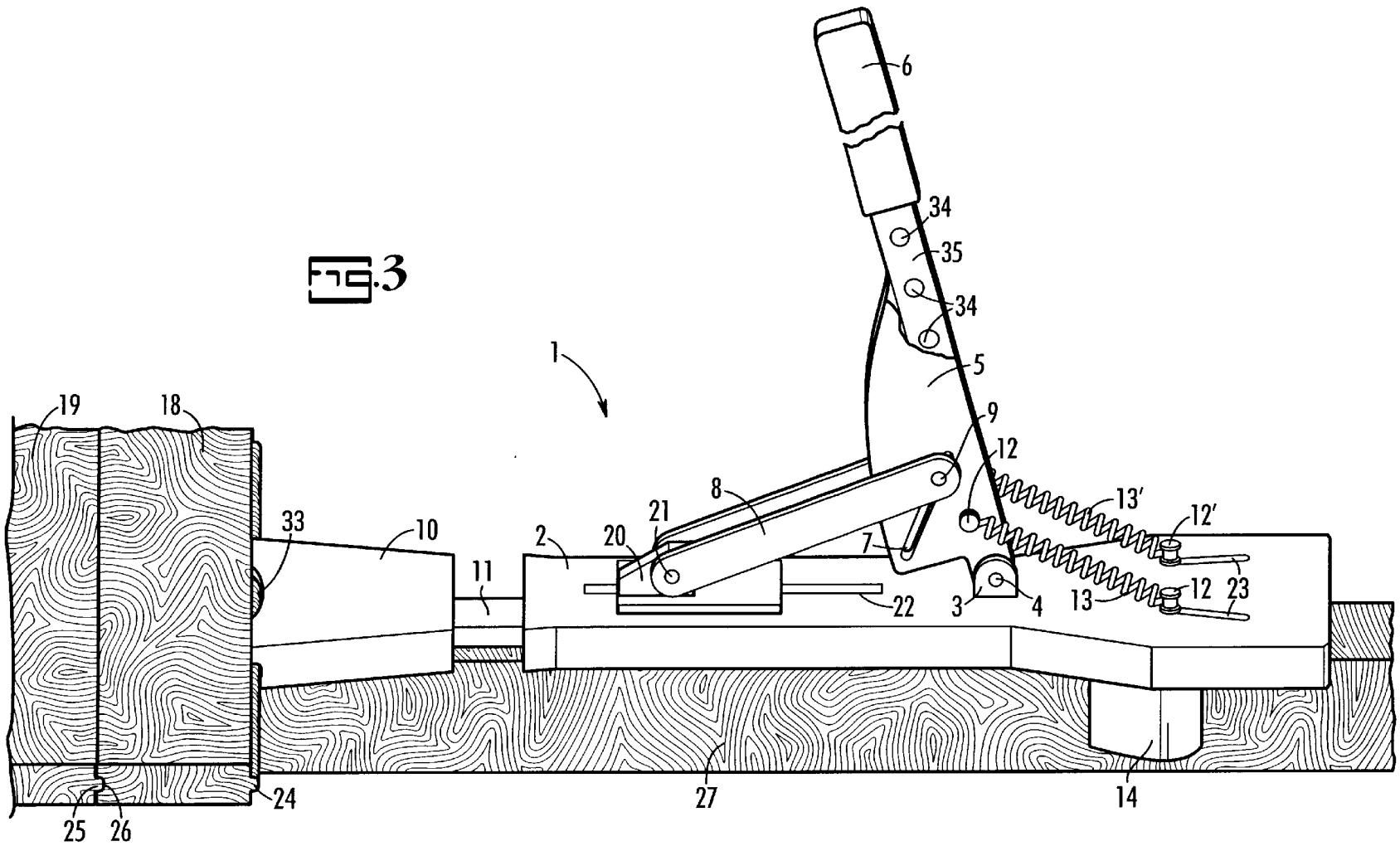
FIG. 3 is side view of an embodiment of the planking tool wherein the handle has been actuated causing the rear teeth to engage the joist and the push bar to force the plank into proper location.

FIG. 3 illustrates the planking tool, 1, fully extended. The actuating plate, 5, is rotated to its fullest extent forward towards the installation plank, 18. Each spring, 13, has been extended thereby persuading the teeth forward, and inward due to the triangulated recess, to an engaging relationship with the joist, 27. The connecting bar, 8, and attachment block, 20, are forward thereby causing the slide rod, 11, to extend beyond the base which in turn extends the push plate, 10, thereby causing the installation plank, 18, to be in an engaging relationship with the secured plank, 19. With tongue and groove planking, an engaging relationship is achieved when the tongue and groove are correctly mated. If other planking is used the engaging relationship is when the planks are in proper relative relationship. It would be apparent to one of ordinary skill in the art that the installation plank would be secured in place prior to the push plate being withdrawn towards the base. A preferred handle assembly is illustrated in FIG. 3 wherein the handle, 6, is attached to the actuator plate, 5, by a bracket, 35, and connectors, 34.

The connecting mechanism between the actuating plate, 5, and the teeth, 14, allows the actuating plate to rotate forward while withdrawing the teeth forward. It is necessary for the teeth to engage the joist and therefore be encumbered from further movement. Springs are particularly suitable for this application. The spring is sufficiently strong to draw the teeth forward yet once the teeth are engaged the spring extends thereby allowing the handle to traverse far enough to actuate the extension mechanism while still maintaining force on the teeth. Other methods could be employed for this function such as nestled pressurized tubes and the like. Springs are preferred due to the simplicity of operation and relatively low cost.

The connection mechanism between the push plate, 10, and actuating plate, 5, is designed to allow sufficient force without deviation in direction. While not restricted to the mechanism described the mechanism preferably does not allow the plank to lift since this could place the plank in a position that is not appropriate for securing. Likewise, the extension mechanism preferably does not allow movement to the side since this may cause the operator to apply force in a direction that is not directed to movement of the plank into proper position and is therefore likely to represent an inefficient operation.

The push plate is illustrated herein as pushing perpendicular to the joist. This is the preferred orientation. Other orientations can be utilized without departing from the scope of the present invention. A trapezoidal, or other shape, push plate may be utilized to allow the plank to be pushed at an angle relative to the joist.

The material of construction is not limiting herein. The choice of material is based on weight and strength. It would be apparent that the apparatus must be sufficiently strong to allow a substantial amount of pressure to be applied to the installation plank. A conflicting desire is that the planking tool be lightweight. Metals, particularly aluminum, are adequate for demonstrating the invention. Composites and alloys are suitable. All of the various components may be made from the same or a similar material. Various components can be manufactured from materials that are not as strong yet they are lightweight. While the various components are solid in the exemplary model illustrated herein hollow components can be utilized as can components comprising various depressions to minimize weight.

Connectors are described broadly herein since the manner in which various components are attached is not limiting. Due to simplicity, mating threaded members are most preferred. Connectors include all of the standard methods for attaching two elements including, but not limited to: mating threaded members or a threaded void in one component for receiving a threaded rod; adhesives; mechanical connections such as welding and the like; etc.

The present invention has been describe with particular emphasis on the preferred embodiments. It would be apparent that other embodiments, alterations and configurations including locking mechanisms, etc. could be envisioned without departing from the scope of the invention which is more specifically set forth in the claims appended hereto.

What is claimed is:

1. A planking tool comprising:

a base;

a handle mechanism rotatably attached to said base;

a pair of teeth slidably attached to said base wherein said teeth are movable between an engaging position and a disengaging position;

a first connecting mechanism attaching said handle mechanism to said pair of teeth;

a push plate slidably attached to said base wherein said push plate is slidable between an extended position and a withdrawn position;

a second connecting mechanism attaching said handle mechanism to said push plate; wherein when said handle is rotated relative to said base said pair of teeth move from said disengaging position to said engaging position while said push plate remains in said withdrawn position and as said handle continues to rotate relative so said base said pair of teach remain in said engaging position and said push plate moves from said withdrawn position to said extended position.

2. The planking tool of claim 1 wherein said first connecting mechanism comprises a spring.

3. The planking tool of claim 1 wherein said handle mechanism comprises an actuator plate.

4. The planking tool of claim 3 wherein said actuator plate comprises an elongated slot.

5. The planking tool of claim 4 wherein said second connecting mechanism slides in said slot when said teeth move to said engaging position.

6. The planking tool of claim 1 wherein said second connecting mechanism comprises a slide bar slidably attached to said base.

7. A method for installing a plank on a joist comprising the steps of:

placing said plank on said joist;

placing a planking tool on said joist wherein said planking tool comprises a handle, a pair of opposing teeth and an extension mechanism;

moving said handle of said planking tool toward said plank wherein said opposing teeth engage said plank;

moving said handle of said planking tool further towards said plank wherein said extension mechanism pushes said plank to an engaged relationship with a previously installed second plank; and securing said plank to said joist.

8. The method for installing a plank on a joist of claim 7 wherein said handle comprises an actuator plate.

9. The method for installing a plank on a joist of claim 8 wherein said actuator plate comprises an elongated slot.

10. The method for installing a plank on a joist of claim 9 wherein said second extension mechanism slides in said slot when said teeth engage said slot.

11. The method for installing a plank on a joist of claim 7 wherein said extension mechanism comprises a slide bar slidably attached to a base.

12. A planking tool comprising:

a base;

an actuating plate rotatably attached to said base;

a pair of opposing teach slidably attached to said base;

a connector attached between said actuating plate and a tooth of said pair of opposing teeth;

a push plate extendable from said base;

a connecting rod slidably connected to said actuating plate and connected to said push plate; wherein when said handle is rotated relative to said base said tooth slides to an engaging relationship while said connecting rod slides relative to said actuating plate and then said connecting rod moves in concert with said actuating plate causing said push plate to extend from said base.

13. The planking tool of claim 12 wherein said connector is a spring.

14. The planking tool of claim 12 further comprising a second connector attached to a second tooth of said pair of opposing teeth.

15. The planking tool of claim 12 further comprising a slide rod between said connecting rod and said push plate and slidably attached to said base.

16. The planking tool of claim 12 wherein said tooth is received in a recess in said base.

17. The planking tool of claim 16 wherein said base comprises a triangulated recess.

18. The planking tool of claim 12 further comprising a spreader between said teeth.

19. The planking tool of claim 12 wherein said actuating plate further comprises an elongated slot.

* * * * *